US007017908B1

(12) United States Patent
Tan et al.

(10) Patent No.: US 7,017,908 B1
(45) Date of Patent: Mar. 28, 2006

(54) MATCHING CARD GAME AND METHOD OF PLAYING THE SAME

(76) Inventors: Eugene Mark Tan, 2110 Newton St., Akron, OH (US) 44305; Jeanne Berenice Tan, 2110 Newton St., Akron, OH (US) 44305

( * ) Notice: Subject to any disclaimer, the term of this patent is extended or adjusted under 35 U.S.C. 154(b) by 170 days.

(21) Appl. No.: 10/417,514

(22) Filed: Apr. 18, 2003

(51) Int. Cl.
*A63F 1/00* (2006.01)

(52) U.S. Cl. ..... 273/292; 273/146

(58) Field of Classification Search ..... 273/292, 273/293, 299, 307, 146
See application file for complete search history.

(56) References Cited

U.S. PATENT DOCUMENTS

| | | | | |
|---|---|---|---|---|
| 848,542 | A * | 3/1907 | Ferris | 273/306 |
| 1,024,194 | A * | 4/1912 | Frank | 273/236 |
| 4,807,885 | A * | 2/1989 | Chamblee et al. | 273/292 |
| 5,067,724 | A * | 11/1991 | Rinkavage | 273/292 |
| 5,718,430 | A | 2/1998 | Aramapakul et al. | |
| 5,803,460 | A | 9/1998 | Hesse | |
| 6,050,568 | A | 4/2000 | Hachquet | |
| 6,131,909 | A | 10/2000 | Chilese | |
| 6,193,235 | B1 | 2/2001 | Vancura et al. | |
| 6,234,483 | B1 | 5/2001 | Bucan | |
| 6,488,284 | B1 | 12/2002 | Webb | |

OTHER PUBLICATIONS http://www.pagat.com/eights/crazy8s.html, "Crazy Eights", by John McLeod, 1996.*
http://www.centralconnector.com/GAMES/unorules.html, "UNO", Mar./2005.*

* cited by examiner

*Primary Examiner*—William M. Pierce
(74) *Attorney, Agent, or Firm*—John D. Gugliotta; P. Jeff Martin

(57) ABSTRACT

A matching card game is provided. The object of the game is the speed with which a player can dispose of his cards before his opponent. The card game requires each player to react to card indicia with speed and keen sensitivity in order to facilitate speedy disposal of one's cards. The card game includes a card deck having base cards and variety cards which are embellished in various colors and indicia, as well as commands or actions such as pick 1 and jump 1. A die marked with indicia is utilized for choosing a dealer as well as for collecting the letters "S" "P" "E" "E" "D" by each round winner for determining ultimate game card winner.

6 Claims, 3 Drawing Sheets

MATCHING CARD GAME AND METHOD OF PLAYING THE SAME

RELATED APPLICATIONS

The present invention was first described in Disclosure Document Registration No. 526,507 filed on Feb. 21, 2003 under 35 U.S.C. §122 and 37 C.F.R. §1.14. There are no previously filed, nor currently any co-pending applications, anywhere in the world.

BACKGROUND OF THE INVENTION

1. Field of the Invention

The present invention relates generally to card games and, more particularly, to a matching card game necessitating quick card indicia recognition and speed of player play.

2. Description of the Related Art

Many different types of card games are played throughout the world. Trick-taking type card games are enjoyed by many in view of their uncomplicated rules or need to have a certain level of skill in order to have a realistic chance of winning. Trick-taking card games generally involve players having the same number of cards and one of the players plays the first card in response to a trick card or face-up card. There are frequently restrictions on which cards a player is permitted to play to a trick and such restrictions commonly depend on the card first played to the trick, and may depend on cards subsequently played. The game generally continues one after another while players' hands get smaller and smaller. However, many of the historically common trick-taking card games have failed to incorporate variety-type cards within rules of play affording players to quickly dispose of their cards while technically doing so out-of-turn. In addition, these common trick-taking card games have failed to combine an additional round of play requiring a round winner to roll a die to obtain certain combinations of letters or symbols in order to become the ultimate game winner.

Accordingly, a need has arisen for a matching card game by which a player is required to react to card indicia with speed and keen sensitivity in order to facilitate speedy disposal of one's cards through the use of variety cards. The development of the matching card game fulfills this need.

A search of the prior art did not disclose any patents that read directly on the claims of the instant invention; however, the following references were considered related.

The following patents disclose various card games and methods of play therefor:

U.S. Pat. No. 6,234,483 B1, issued in the name of Bucan; U.S. Pat. No. 5,803,460, issued in the name of Hess; U.S. Pat. No. 6,193,235 B1, issued in the name of Vancura et al.; U.S. Pat. No. 6,131,909, issued in the name of Chilese; U.S. Pat. No. 6,050,568, issued in the name of Hachquet; U.S. Pat. No. 5,718,430, issued in the name of Aramapakul et al.; and U.S. Pat. No. 6,488,284 B2, issued in the name of Webb.

Consequently, a need has been felt for a matching card game which requires each player to react to card indicia with speed and keen sensitivity in order to facilitate speedy disposal of one's cards.

SUMMARY OF THE INVENTION

Therefore, it is an object of the present invention to provide a matching card game wherein the object of the game is the speed with which a player can dispose of his cards before his opponent.

It is another object of the present invention to provide a card game which includes a card deck having a total of ninety-six cards.

It is another object of the present invention to provide a card game which is executed in a clockwise manner.

It is another object of the present invention to provide a card game wherein the card deck defines base cards and variety cards.

It is another object of the present invention to provide base cards having letter indicia located on a face thereof, wherein letter indicia comprise seven different letters designated as a single letter on each base card selected from the group consisting of "S," "P," "E," "D," "J," "U," and "M."

It is another object of the present invention to provide base cards which include action cards.

It is another object of the present invention to provide base cards being embellished in eight different colors which include green, blue, yellow, red, purple, orange, pink, and black.

It is another object of the present invention to provide action cards which include pick 1, a jump 1, and a jump 2 cards.

It is another object of the present invention to provide variety cards which include speedbrake, jump 1, jump 2, pick 1, pick 3, give 1, and give 3 cards.

It is another object of the present invention to provide a die which is marked on each face thereof with individual indicia which includes an "S," a "P," an "E," another "E," a "D," and a star for choosing the dealer and for determining ultimate game winner.

Briefly described according to one embodiment of the present invention, a matching card game is provided. The object of the game is the speed with which a player can dispose of his cards before his opponent. The card game requires each player to react to card indicia with speed and keen sensitivity in order to facilitate speedy disposal of one's cards. The card game is executed in a clockwise manner, thus players are seated in a generally circular arrangement.

The card game includes a card deck comprised of a total of ninety-six cards, and wherein card deck defines base cards and variety cards. The base cards have letter indicia located on a face thereof, wherein letter indicia comprise seven different letters designated as a single letter on each base card selected from the group consisting of "S," "P," "E," "D," "J," "U," and "M."

The base cards further include a plurality of action cards comprised of a pick 1 card, a jump 1 card, and a jump 2 card. Each base card is embellished in eight different colors which include green, blue, yellow, red, purple, orange, pink, and black. Thus, the base cards constitute eighty cards of the ninety-six card total. The jump 1 card obligates a following player to be jumped and loses his/her turn at play. The jump 2 card functions in substantially the same manner as the jump 1 card, with exception being jump 2 card facilitates jumping of two players. Regarding the pick 1 card, a following player is required to pick one card from a face-down pile, and additionally loses his/her turn of play.

The variety cards are comprised of five speedbrake cards, one jump 1 card, one jump 2 card, one pick 1 card, two pick 3 cards, four give 1 cards, and two give 3 cards. The speedbrake cards are matchable with any color or letter. The speedbrake card requires the player playing such card to choose either a particular color or letter for the next player to match, based upon the card the speedbrake card was played on. The jump 1 card and jump 2 card variety cards are played in the same manner as the jump 1 and jump 2 action cards coupled with the advantage of being matchable to any card color or card letter. The pick 1, pick 3 variety cards are played in the same manner as the pick 1 action cards coupled with the advantage of being matchable with any like card color or other pick 1 cards action cards, or pick 1 card, pick 3 card variety cards. The give 1 variety cards allow a player to give any one of his/her cards to another player of his/her choice, and are matchable to any like card color or card letter. The give 3 variety cards are played in much the same manner as give 1 variety cards with exception of allowing a player to give away three cards from his/her hand. The give 3 variety cards are matchable to any like color card, card letter, and give 1 variety cards.

A dealer is chosen upon the rolling of a die which is marked on each face thereof with individual indicia which includes an "S," a "P," an "E," another "E," a "D," and a star. Each player rolls the die, whereupon a first player to roll the star is designated as the dealer for that round of play. The first player immediately left of dealer is the starting player. The starting or first player must match the card on the face-up pile with a base card either by letter, color, or symbol. Alternatively, first player can place down a variety card. In the event a present player is without a card being matchable to the face-up card, present player must draw from the face-down pile until receiving a matching card.

The winner of the card game is the first player who both disposes of his cards before his opponent, and as a winner in each round, rolls the die once to collect the letters "S" "P" "E" "E" "D." In the event a winner of a round rolls a letter he/she has already obtained, his/her turn is lost and he/she must win an additional round to have an opportunity to collect a required letter. If a player rolls the star, such player is allowed to select a letter of his/her choice.

The use of the present invention provides an entertaining, fast-paced card game which allows each player to have a realistic chance of winning.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENT

Detailed Description of the Figures

Figure 1:
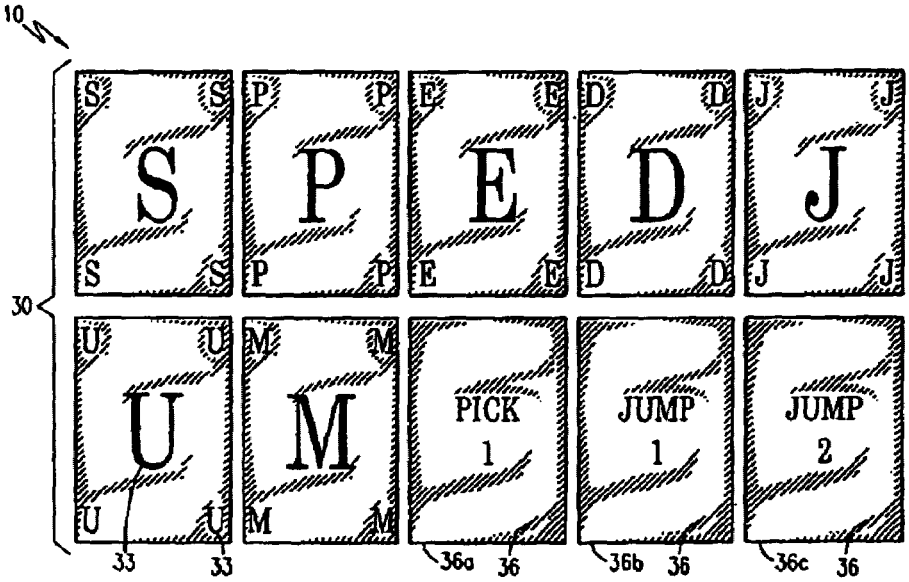
FIG. 1 is a top side view of the base cards of the matching card game according to the preferred embodiment of the present invention.
Figure 2:
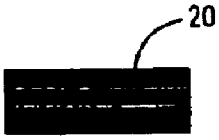
FIG. 2 is a side elevational view of the card deck according to the preferred embodiment of the present invention.
Figure 3:
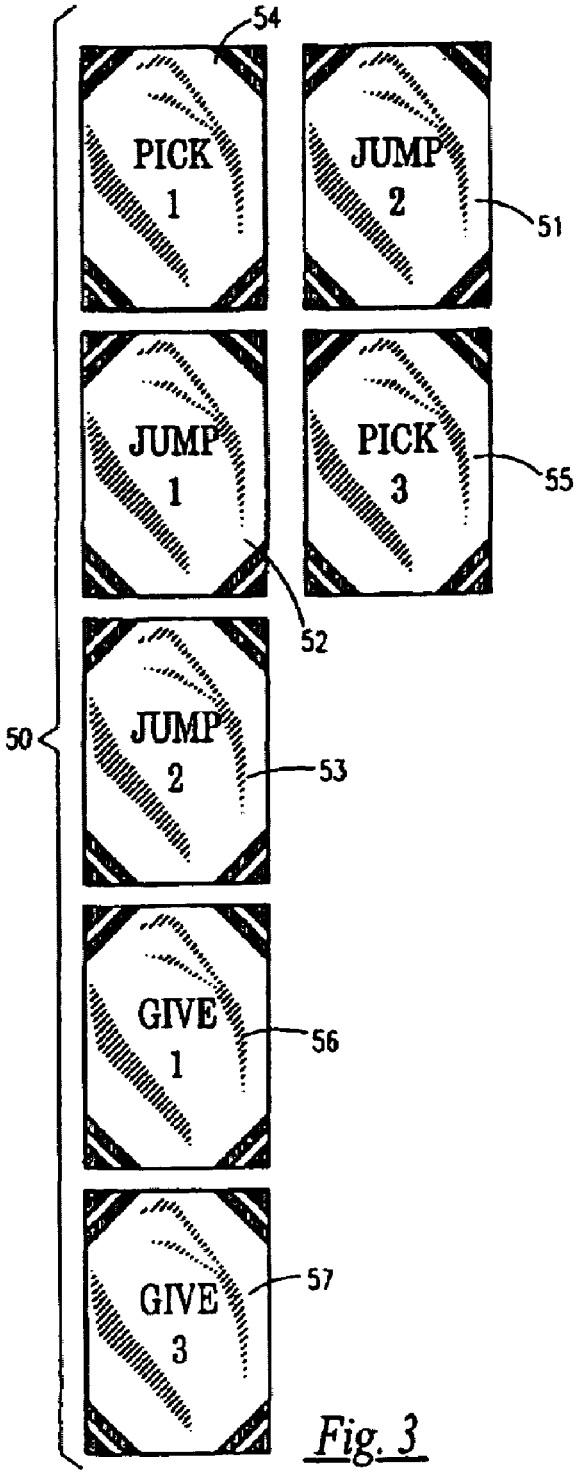
FIG. 3 is a top side view of the variety cards according to the preferred embodiment of the present invention.

Referring now to FIGS. 1–3, a matching card game and method of playing the same 10 is shown with a description of the preferred embodiment in accordance therewith, wherein the object of the game being the speed with which a player can dispose of his cards before his opponent.

The matching card game and method of playing the same 10, hereinafter card game 10, is best suited to be played by two to eight players. However, it is expressly understood that more than eight players may be utilized and thus the teachings of the present invention are not to be limited to eight. The card game 10 includes a card deck 20 comprised of a total of ninety-six cards. The card deck 20 is further defined as having base cards 30 and variety cards 50. The base cards 30 are defined with letter indicia 33 on a face thereof, wherein letter indicia 33 is located centrally and in each quadrant. The letter indicia 33 in each quadrant is of a smaller typographical character relative to central letter indicia.

The letter indicia 33 comprise seven different letters wherein each base card 30 is individually designated with a single letter selected from the group consisting of "S," "P," "E," "D," "J," "U," and "M."

The base cards 30 further include a plurality of action cards 36, the function of which to be described in greater detail below. The action cards 36 include a pick 1 card 36*a*, a jump 1 card 36*b*, and a jump 2 card 36*c*. Each base card 30 is embellished in eight different colors which include green, blue, yellow, red, purple, orange, pink, and black. Thus, the base cards 30 constitute eighty cards of the ninety-six card total.

The variety cards 50 are comprised of five speedbrake cards 51, one jump 1 card 52, one jump 2 card 53, one pick 1 card 54, two pick 3 cards 55, four give 1 cards 56, and two give 3 cards 57, wherein the function of each is to be described in greater detail below. The variety cards 50 are ornamented with a spectrum of colors positioned in corners of each quadrant thereof.

The card game 10 is executed in a clockwise manner, thus players are seated in a generally circular arrangement. The action cards 36 are used by a player in the following manner. Regarding the jump 1 card 36*b*, once a player has placed such card down, the player to his immediate left is jumped and loses his/her turn at play. Other players can discard jump 1 cards 36*b* of any color in their possession. The next player is determined from the last discarded jump 1 card 36*b* by counting the number of jump 1 cards 36*b* which were discarded clockwise from the last player who placed down a jump 1 card 36*b*. For example, if a jump 1 card 36*b* is placed down followed by five sequential players who also place down jump 1 cards 36*b*, the player who last placed down a jump 1 card 36*b* counts off clockwise to his/her left to determine that it is the seventh player's turn at play. Jump 1 cards 36*b* are played on cards of a same color thereas, on other action jump 1 cards 36*b*, jump 2 cards 36*c*, and on a variety jump 1 card 52.

The jump 2 card 36*c* functions in substantially the same manner as jump 1 card 36*b*, with exception being jump 2 card 36*c* facilitates jumping of two players. For example, if six jump 2 cards 36*c* are placed down, the last player to place down a jump 2 card 36 counts off clockwise to his/her left to determine it is the thirteenth player's turn at play. In the event a combination of jump 1 cards 36*b* and jump 2 cards 36*c* are placed down, the next player's turn is determined by counting the total number of jump 1, jump 2 cards 36*b*, 36*c* on the face-up pile.

Regarding the pick 1 card 36*a*, after being played by a player, the next player picks one card from the face-down pile, and additionally loses his/her turn of play. The pick 1 card 36*a* can be played with other pick 1 cards 36*a* or pick 3 cards 55, (to be described in greater detail below) or other cards of a same color. Thus, in the event speedy players place down pick 1 cards 36*a*, the next player obligated to pick a card from the face-down pile is the player next to the last player who discarded a pick 1 card 36*a*. For example, if a total of five pick 1 cards 36*a* are played, the player next to the player who placed down the last pick 1 card 36*a* must pick five cards from the face-down pile, and additionally loses his/her turn of play.

Referring now to FIG. 3, the variety cards 50 are used by a player in the following manner. The speedbrake cards 51 are matchable with any color or letter. Thus if a "Blue S" card is played by a prior player, the player placing down a speedbrake card 51 must choose either the color "Blue" or the letter "S", for the next player to match, but the player placing down the speedbrake card 51 is not permitted to choose a same color and letter as was played on, for example a "Blue S".

The jump 1 card 52 and jump 2 card 53 variety cards 50 are played in the same manner as the jump 1 card 36*b* and jump 2 card 36 action cards 36 coupled with the advantage of being matchable to any card color or card letter.

The pick 1, pick 3 cards 54, 55 variety cards 50 are played in the same manner as the pick 136*a* action cards 36 coupled with the advantage of being matchable with any like card color or other pick 1 cards 36*a* action cards 36, or pick 1 card 54, pick 3 card 55 variety cards. In addition, after a pick 3 card 55 is played by a player, the next player picks three cards from the face-down pile, and additionally loses his/her turn of play.

The give 1 cards 56 allow a player to give any one of his/her cards to another player of his/her choice. A player is entitled to play a give 1 card 56 and also give a card of his/her choice to another player. The next player is the player who receives the given card, and is also the player to decide a letter or color for game continuation. However, if a subsequent player placed down a give 1 card, the first player placing down the initial give 1 card 56 loses his/her turn to give away a card from his/her hand. The player who discarded the last give 1 card 56 counts the number of give 1 cards 56 lying in the face-up pile and gives away that number of cards from his/her hand to another player of his/her choice. The give 1 cards 56 are matchable to any like card color or card letter.

The give 3 cards 57 are played in much the same manner as give 1 cards 56 with exception of allowing a player to give away three cards from his/her hand. The give 3 cards 57 are matchable to any like color card, card letter, and give 1 cards 56. Thus, a give 1 card 56 is followable to a give 3 card 57 and vice versa.

Figure 4:
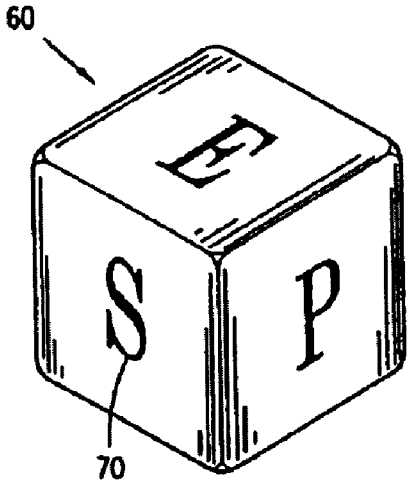
FIG. 4 is a perspective view of the die according to the preferred embodiment of the present invention.
Figure 5:
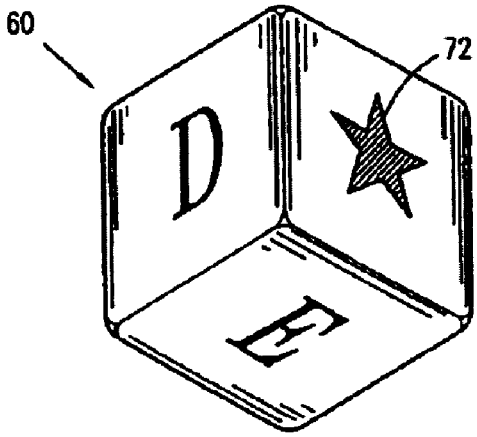
FIG. 5 is a supplemental perspective view of the die according to the preferred embodiment of the present invention.

Referring now to FIGS. 1–3, and more specifically to FIGS. 4 and 5, a dealer, or game facilitator is chosen upon the rolling of a die 60. The die 60 is defined as a small cube 62 marked on each face thereof with individual indicia 70 which includes an "S," a "P," an "E," another "E," a "D," and a star 72, whereby the die 60 is thrown to come to rest at random on a flat surface. Each player rolls the die 60, whereupon a first player to roll the star 72 is designated as the dealer for that round of play. Dealer shuffles the card deck 20 of ninety-six cards and distributes eight cards to each player. Dealer then places the remaining cards in a face-down pile, and turns the first card off the pile face up.

The first player immediately left of dealer is the starting player. The starting or first player must match the card on the face-up pile with a base card 30 either by letter, color, or symbol. For example, if face-up card is a "Blue S", the present player is obligated to match it by placing down a blue card of any letter or an "S" of any color. Alternatively, first player can place down a variety card 50. The variety card 50 is playable on a card of any suit.

In the event a present player is without a card being matchable to the face-up card, present player must draw from the face-down pile until receiving a matching card and placing such matching card atop the face-up pile. During an interval of play, in the event other players have a matching letter card, such players may place their matching cards on the face-up pile, even if it is not players' turn. However, such card must be played before a next player changes card suit. The card game 10 continues from a last card discarded, and a next player must match the last card placed on the face-up pile.

In the event all cards in the face-down pile have been drawn, dealer shuffles all cards in the face-up pile and places them face down with the last played face-up card placed atop the freshly shuffled face-down pile.

In order to choose a different or succeeding dealer, such dealer is simply the player to the immediate right of the previous dealer.

The winner of the card game 10 is the first player who both disposes of his cards before his opponent, and as a winner in each round, rolls the die 60 once to collect the letters "S" "P" "E" "E" "D." In the event a winner of a round rolls a letter he/she has already obtained, his/her turn is lost and he/she must win an additional round to have an opportunity to collect a required letter. It is, however, understood that a player is allowed to collect two "E" letters. In the event a player rolls the star 72, such player is allowed to select a letter of his/her choice.

Therefore, the foregoing description is included to illustrate the operation of the preferred embodiment and is not meant to limit the scope of the invention. As one can envision, an individual skilled in the relevant art, in conjunction with the present teachings, would be capable of incorporating many minor modifications that are anticipated within this disclosure. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be broadly limited only by the following claims.

What is claimed is:

1. A matching card game comprising:

a card deck, said card deck has a total of ninety-six cards, wherein said card deck is further defined as having:

(a) base cards, each of said base cards is embellished in eight different colors which include green, blue, yellow, red, purple, orange, pink, and black, and (b) variety cards, said variety cards are ornamented with a spectrum of colors positioned in corners of each quadrant thereof; and a die, said die is defined as a small cube marked on each face thereof with individual indicia, wherein individual indicia includes an "S," a "P," an "E," another "E," a "D," and a star, whereby said die is adapted to be thrown to come to rest at random on a flat surface.

2. The matching card game of claim 1, wherein said base cards are defined with letter indicia on a face thereof, wherein said letter indicia is located centrally and in each quadrant of each said base cards, said letter indicia in each quadrant is of a smaller typographical character relative to said letter indicia located centrally.

3. The matching card game of claim 1, wherein said variety cads are comprised of:

speedbrake cards, said speedbrake cards totaling five in number;

a jump 1 card, said jump 1 card totaling one in number;

a jump 2 card, said jump 2 card totaling one in number;

a pick 1 card, said pick 1 card totaling one in number;

pick 3 cards, said pick 3 cards totaling two in number;

give 1 cards, said give 1 cards totaling four in number; and give 3 cards, said give 3 cards totaling two in number.

4. The matching card game of claim 2, wherein said letter indicia comprises seven different letters wherein each said base card is individually designated with a single letter selected from the group consisting of "S," a "P," "E," "D," "J," "U" and "M."

5. The matching card game of claim 2, wherein said base cards further comprise a plurality of action cards, wherein said plurality of action cards includes a pick 1 card, a jump 1 card, and a jump 2 card.

6. A method of playing a matching card game, comprising the steps of:

(a) seating players in a generally circular arrangement;

(b) choosing a dealer by each player rolling die, whereupon a first player to roll a star is designated as the dealer;

(c) shuffling card deck by chosen dealer;

(d) distributing eight cards by the dealer to each player;

(e) placing remaining cards by the dealer in a facedown pile;

(f) turning first card off said facedown pile upward by the dealer so as to provide a face-up pile in addition to said facedown pile;

(g) select initial player which is a first player to an immediate left of the dealer;

(h) matching the first card by the initial player with a base card by letter, (i) color, or symbol, or plug a variety card, however, in the event present player is without a card being matchable to the first card or face-up card in the face-up pile, present player must draw from said face-down pile until receiving a matching card and placing the matching card face-up atop said face-up pile;

(j) placing matching cards in remaining players' hands atop said face-up pile during an interval of play before a next player changes card suit, even if not such players' turn at play;

(k) continuing card game until a player's last card is discarded;

(l) shuffling all cards by the dealer in said face-up pile and placing card face-down while taking a last played face-up card and placing it atop a freshly shuffled face-down pile in the event all cards in said face-down pile are drawn before a player has discarded his/her last card;

(m) wining a round of the card game by becoming first player to dispose of his/her cards and who therefore becomes round winner;

(n) rolling said die once by said round winner to collect letters "S" "P" "E" "E" "D" or the star which enables said round winner to select a letter of choice;

(o) selecting a succeeding dealer by choosing a player seated to an immediate right of previous dealer;

(p) wining a required number of rounds by repeating steps (c) through (o) to become a first player to collect the letters "S" "P" "E" "E" "D" in order to become card game winner;

(q) losing a turn at rolling said die upon said round winner rolling an already collected letter; and (r) winning an additional round to have an opportunity to collect a required letter, however said round winner is allowed to collect two "E" letters.

* * * * *